United States Patent [19]

Chern, Shy-Shiun

[11] 4,262,266

[45] Apr. 14, 1981

[54] COAXIAL STUB TUNER

[75] Inventor: Chern, Shy-Shiun, Whittier, Calif.

[73] Assignee: California Institute of Technology, Pasadena, Calif.

[21] Appl. No.: 81,273

[22] Filed: Oct. 2, 1979

[51] Int. Cl.[3] ..... H01P 1/20; H01P 5/04; H01P 7/04

[52] U.S. Cl. ..... 333/33; 333/263

[58] Field of Search ..... 333/24 R, 27, 33, 105, 333/221-223, 206-207, 243, 248, 253, 256, 263

[56] References Cited

U.S. PATENT DOCUMENTS

| | | | |
|---|---|---|---|
| 2,532,993 | 12/1950 | Carter | 333/206 X |
| 2,594,895 | 4/1952 | Feiker, Jr. | 333/263 X |
| 2,851,666 | 9/1958 | Käch | 333/207 |

*Primary Examiner*—Marvin L. Nussbaum
*Attorney, Agent, or Firm*—Freilich, Hornbaker, Wasserman, Rosen & Fernandez

[57] ABSTRACT

A coaxial stub tuner assembly is comprised of a short circuit branch diametrically opposite an open circuit branch. The stub of the short circuit branch is tubular, and the stub of the open circuit branch is a rod which extends through the tubular stub into the open circuit branch. The rod is threaded at least at its outer end, and the tubular stub is internally threaded to receive the threads of the rod. The open circuit branch can be easily tuned by turning the threaded rod in the tubular stub to adjust the length of the rod extending into the open circuit branch.

6 Claims, 3 Drawing Figures

COAXIAL STUB TUNER

ORIGIN OF THE INVENTION

The invention described herein was made in the performance of work under NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to a tuner for high power microwave circuits, and more particularly to a coaxial stub tuner which combines a fixed short circuit branch and a variable open circuit branch in a new configuration which facilitates tuning by varying the stub of the open circuit branch.

A microwave stub tuner is commonly implemented with a short circuit branch that is variable in length. The branch can, in principle, be replaced by an open circuit branch that is longer or shorter by a quarter wavelength. It is preferable to use an open circuit branch because it has less contact problems than the short circuit branch when applied to high power systems. But the open circuit branch has the problem of providing access to the stub for adjustment of its length to tune the branch.

OBJECTS AND SUMMARY OF THE INVENTION

An object of this invention is to provide a coaxial microwave tuner for high power circuits.

Another object is to provide a coaxial microwave stub tuner having an open circuit branch of variable stub length of a new and improved configuration.

These and other objects and advantages of the invention are achieved by a coaxial stub tuner assembly comprised of a short circuit branch diametrically opposite an open circuit branch. The stub of the short circuit branch is a tube through which the variable length stub of the open circuit branch is inserted and adjusted in length. Each branch is comprised of a cylindrical cavity in a block adapted to be connected to the outer conductor of a coaxial line. A center conductor insulated from the block extends through the block at right angles to the common axis of opposing cavities in a position between the cavities. That center conductor is adapted to be connected to the inner conductor of the coaxial line and is connected to the tubular tuning stub. Two or more identical assemblies may be spaced along a coaxial line an appropriate distance.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
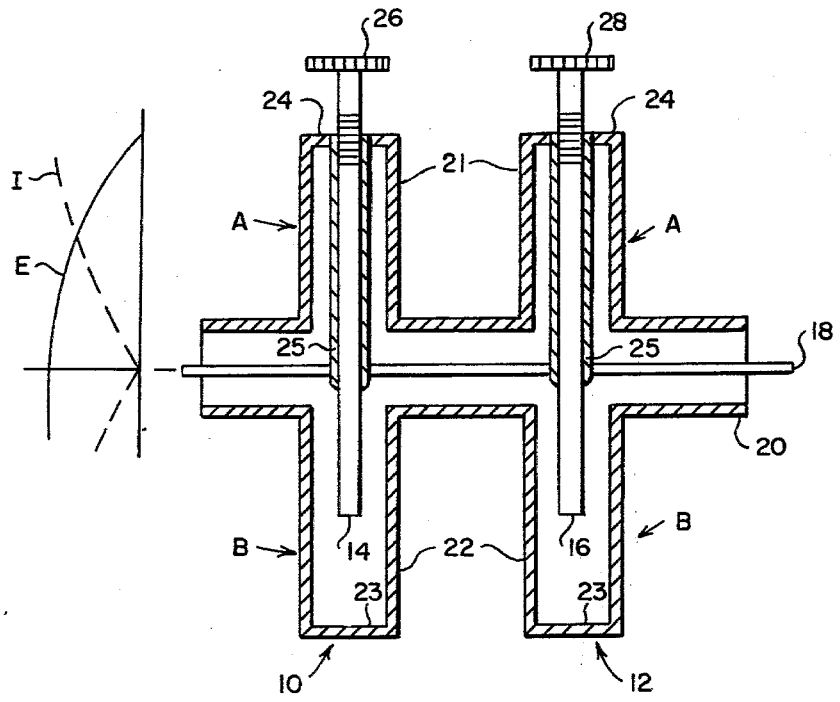
FIG. 1 is a schematic diagram illustrating the basic principles of the present invention.

Referring now to FIG. 1, a high power microwave tuner assembly is comprised of two identical stub tuners 10 and 12 arranged side by side with tuning stubs 14 and 16 a quarter wavelength apart, or other appropriate distance. Each stub tuner consists of a fixed short circuit branch A and a variable open circuit branch B. The two branches of each tuner have coincident axes which intersect the inner conductor 18 of a main transmission coaxial line. The outer conductor 20 of the coaxial line is electrically connected to the outer cylindrical conductors 21, 22 of the branches A and B.

The cylindrical conductor 22 of the open circuit branch B is closed at the end by an end wall 23. The cylindrical conductor 21 of the short circuit branch A is also closed by an end wall 24. Extending from the end wall 24 of each branch A is a tube 25 which intersects the inner conductor 18 of the main coaxial cable. The length of the tube from the inner conductor 18 to the end wall 24 is a quarter wavelength, or an odd number of quarter wavelengths, thus providing a short circuit at the end wall 24, i.e., providing a standing wave in the branch A with a maximum voltage (open circuit) at the inner conductor 18 and a minimum voltage (short circuit) at the end wall 24.

The tuning stubs 14 and 16 for the open circuit branch of each tuner extends through the short-circuit branch tube 25. By threading the stubs and the inside of the tubes, it is very easy to adjust the length of the tuning stubs 14 and 16 into the open circuit branches for tuning by simply turning knurled knobs 26 and 28 on the ends of the stubs.

Figure 2:
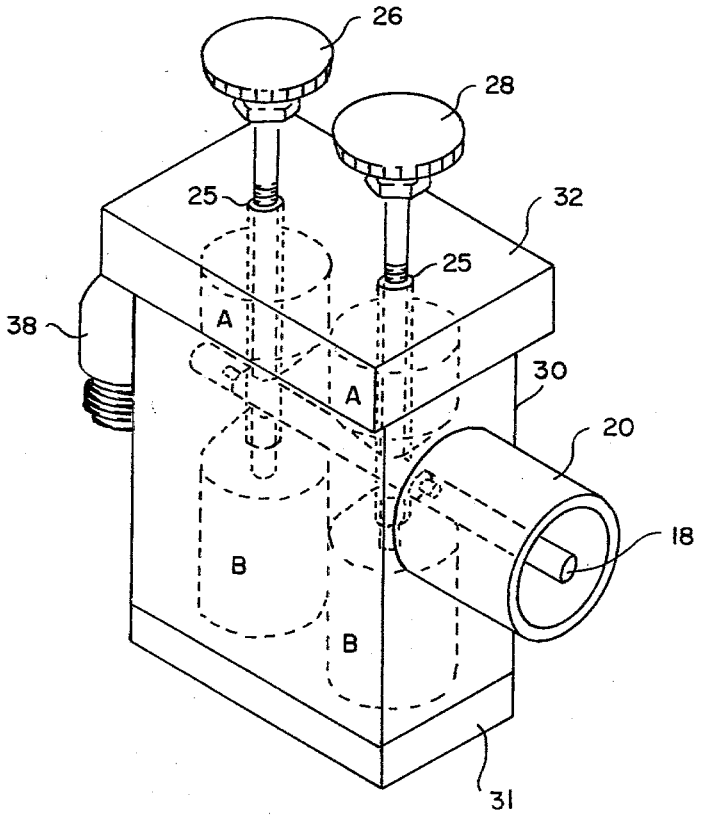
FIG. 2 is an isometric view of an exemplary microwave tuner embodying the principles illustrated in FIG. 1 and showing in phantom the cavity structures of the tuner.
Figure 3:
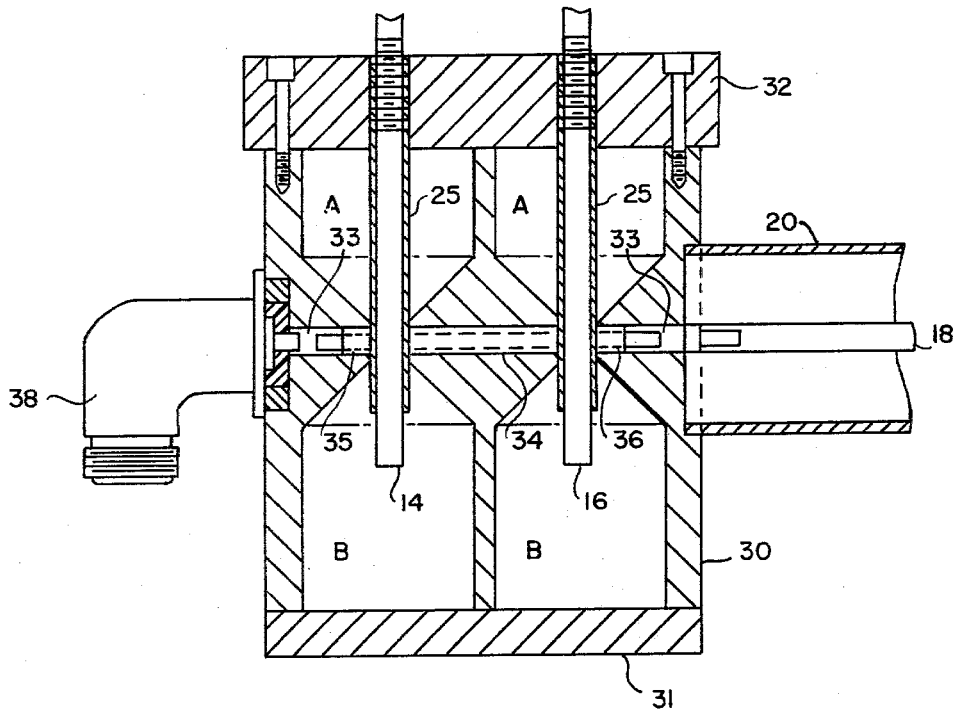
FIG. 3 is a cross-sectional diagram of the microwave stub tuner assembly of FIG. 2.

FIG. 2 illustrates an exemplary implementation of the microwave tuner described with reference to FIG. 1 using a body 30 of conductive material to form the cavities for the two short circuit branches, A, as well. These cavities are indicated by phantom lines in this figure. For a better understanding of how the cavities may be formed, reference is made to FIG. 3. With cover plates 31 and 32 removed, cavities for the two tuners 10 and 12 are drilled using a conical tipped drill bit. Then vertical holes are drilled through the common axis of the two cavities for the tubes 25. But before the tubes 25 are inserted, a transverse hole is drilled for the insulated inner conductor 18 of the coaxial line. To complete assembly, the cover 30 is replaced and permanently secured, as with solder.

A short segment 34 of the insulated inner conductor is inserted into the central part of the body 32 with exposed ends in contact with the tubes 25. Next short segments 34 and 36 of the insulated inner conductor are inserted with the inner ends exposed to contact the tubes 25, and the outer ends uninsulated to provide a coupling probe for coaxial cables at each end. The coaxial cables are secured to the tuner in any convenient manner, such as by a connector 38 shown on the left or permanent connection of a coaxial line shown on the right. Once the tubes 25 and the cover plate 32 are in place, the tuning stubs 14 and 16 may be inserted to complete the assembly.

In operation, microwave energy is applied through the inner conductor 18 of the main coaxial line. Tuning is accomplished by adjusting the length of the tuning stubs 14 and 16 into the cavities of the open circuit branches. The short circuit branch A of each stub tuner 10 and 12 causes no net effect to the system. The short circuit branch merely provides the accessibility to the stubs 14 and 16 for tuning the length of the open circuit branch. The open circuit branch B acts as a variable reactive load to the coaxial cable 40 so that at the traversed point of each open circuit branch, the effective impedance of the load can be changed. For predicted loading conditions, the effective impedance of a load can be changed to a value to match the internal impedance of the power source in two stages of identical microwave tuners at appropriate points on the main coaxial cable.

Although particular embodiments of the invention have been described and illustrated herein, it is recognized that modifications and variations may readily occur to those skilled in the art. For example, the short circuit branch shown as being of a fixed length may be made variable in length, but prefixed upon installation. In that manner the same structure may be assembled for a number of different applications of different wavelengths. Consequently, it is intended that the claims be interpreted to cover such modifications and equivalents.

What is claimed is:

1. A coaxial stub tuner assembly comprised of a short circuit branch diametrically opposite an open circuit branch, said short circuit branch having a tubular stub, and said open circuit branch having a stub consisting of a rod which extends through said tubular stub into said open circuit branch said rod also extending outside of said short circuit branch to permit tuning said open circuit branch by adjusting the length that said rod extends into said open circuit branch.

2. A coaxial stub tuner assembly as defined in claim 1 wherein said rod is threaded at least at its outer end, and said tubular stub is internally threaded to receive the threads of said rod, whereby the open circuit branch can be easily tuned by turning the threaded rod in the tubular stub to adjust the length of the rod extending into the open circuit branch.

3. A coaxial stub tuner assembly comprised of a short circuit branch diametrically opposite a variable open circuit branch, said short circuit branch having a tubular conductive stub extending through a cavity in an outer conductor of said short circuit branch to a transverse center conductor adapted to be coupled to an inner conductor of a coaxial line, said short circuit cavity being an odd number of wavelengths long, and another conductive stub in electrical contact with said tubular stub, said other stub extending through said tubular stub into a cavity in an outer conductor of said open circuit branch of a length greater than or less than said short circuit branch by a quarter wavelength, whereby the stub length in said open circuit branch may be adjusted from outside the short circuit branch.

4. A microwave stub tuner assembly having a short circuit branch and a diametrically opposite variable open circuit branch, said short circuit branch comprising a conductive member having a cylindrical cavity an odd number of quarter wavelengths long adapted to be connected to an outer conductor of a coaxial line, and a hollow stub centered on the axis of said cavity and extending from an end wall of said cylindrical cavity to a center conductor adapted to be connected to the inner conductor of said coaxial line, and said open circuit branch comprising a conductive member having a cylindrical cavity with its axis extending through the axis of the cavity of said short circuit branch and a tuning stub passing through said end wall of said cavity of said short circuit branch and through said hollow stub into said cavity of said open circuit branch for tuning by adjustment of the length said tuning stub extends into said cavity of said open circuit branch, said tuning stub maintaining good electrical contact with said hollow stub in its adjusted position, and said open circuit branch being longer or shorter than said short circuit branch by a quarter wavelength.

5. A microwave stub tuner as defined in claim 4 wherein said tuning stub is a rod threaded at least at its outer end, and said hollow stub is internally threaded to receive the threads of said tuning stub, thereby to adjust tuning by turning said tuning stub.

6. A microwave stub tuner as defined in claim 4 wherein a plurality of substantially identical assemblies of short circuit and open circuit branches spaced along a coaxial transmission line.

* * * * *